US009650701B2

(12) United States Patent
Parsons

(10) Patent No.: US 9,650,701 B2
(45) Date of Patent: May 16, 2017

(54) EROSION RESISTANT MATERIAL

(75) Inventor: Michael E. Parsons, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 1004 days.

(21) Appl. No.: 12/681,768

(22) PCT Filed: Sep. 9, 2008

(86) PCT No.: PCT/US2008/075735

§ 371 (c)(1),
(2), (4) Date: Apr. 5, 2010

(87) PCT Pub. No.: WO2009/048706

PCT Pub. Date: Apr. 16, 2009

(65) Prior Publication Data

US 2010/0221564 A1 Sep. 2, 2010

Related U.S. Application Data

(60) Provisional application No. 60/978,666, filed on Oct. 9, 2007.

(51) Int. Cl.

| | |
|---|---|
| ***C22C 29/00*** | (2006.01) |
| ***C22C 1/04*** | (2006.01) |
| *B22F 3/24* | (2006.01) |

(52) U.S. Cl.

CPC ..... *C22C 29/005* (2013.01); *C22C 1/0441* (2013.01); *C22C 1/0491* (2013.01); *B22F 2003/248* (2013.01); *B22F 2998/10* (2013.01)

(58) Field of Classification Search

USPC ..... 428/698, 539.5, 545; 264/667, 668, 683; 501/96.5, 98.1, 98.2, 98.3, 153, 96.1; 75/228, 230, 232, 235, 237, 238; 419/10, 419/13, 14, 19, 29, 30, 32, 38, 39, 48, 49

See application file for complete search history.

(56) References Cited

U.S. PATENT DOCUMENTS

| | | | | |
|---|---|---|---|---|
| 4,131,459 | A * | 12/1978 | Fletcher et al. | 419/13 |
| 4,184,884 | A * | 1/1980 | Jong | 501/98.1 |
| 4,728,078 | A * | 3/1988 | Oda et al. | 251/360 |
| 4,909,842 | A * | 3/1990 | Dunmead | C22C 1/058 428/614 |
| 4,919,718 | A * | 4/1990 | Tiegs et al. | 75/232 |
| 4,945,073 | A | 7/1990 | Dubensky et al. | |
| 4,988,488 | A * | 1/1991 | Kang | 423/210.5 |
| 5,060,374 | A * | 10/1991 | Findlanl | B22F 7/08 29/888.44 |
| 5,089,047 | A * | 2/1992 | Buljan | C22C 29/005 428/610 |
| 5,118,646 | A * | 6/1992 | Siebein et al. | 501/98.1 |
| 5,464,583 | A | 11/1995 | Lessing | |
| 5,482,673 | A * | 1/1996 | Alexander et al. | 419/48 |
| 5,503,122 | A | 4/1996 | Ritland et al. | |
| 5,633,214 | A * | 5/1997 | Nishio | C04B 35/583 501/92 |
| 5,905,937 | A * | 5/1999 | Plucknett et al. | 419/12 |
| 6,566,990 | B2 * | 5/2003 | Oyama et al. | 335/220 |
| 6,573,210 | B1 * | 6/2003 | Claussen et al. | 501/127 |
| 6,589,899 | B2 | 7/2003 | Sekine et al. | |
| 6,887,569 | B1 * | 5/2005 | Kriven | C04B 35/6264 428/688 |
| 2006/0178256 | A1 * | 8/2006 | Yeckley | 501/98.1 |
| 2007/0131054 | A1 * | 6/2007 | Bangaru | C22C 29/14 75/235 |

FOREIGN PATENT DOCUMENTS

| | | |
|---|---|---|
| DE | 3935496 | 7/1990 |
| EP | 1134363 | 9/2001 |
| WO | 2005/114835 A2 | 12/2005 |

OTHER PUBLICATIONS

I.-W. Chen and R. Shuba, "Si-AION Ceramics, Structure and Properties of," Encyclopedia of Materials: Science and Technology (Second Edition), Elsevier, Oxford, 2001 (Available online Jan. 1, 2003), pp. 8471-8475.*

PCT International Search Report and Written Opinion for PCT/US2008/75735, dated Feb. 9, 2009.

Deevi et al.; "Processing, Properties, and Applications of Nickel and Iron Aluminides"; Progress in Materials Science, vol. 42, 1997, pp. 177-192.

Deevi et al.; "Nickel and Iron Aluminides; An Overview on Properties, Processing, and Applications"; Intermetallics, Elsevier Science Publishers; vol. 4, No. 5; Jan. 1, 1996.

Tiegs et al.; "Comparison of Sintering Behavior and Properties of Aluminide-Bonded Ceramics"; Ceramic Engineering and Science Proceedings, Columbus, US, vol. 19, No. 3; Jan. 1, 1998.

Great Britain Examination Report for GB Application No. GB1005860.0 dated Nov. 12, 2012.

K93700 AirJet Erosion Tester; Catalog No. K93700; www.koehlerinstrument.com; 2 pages; 2008.

Cameron Distributed Valves; Thornhill Craver Chokes and Couplings; www.c-a-m.com; 32 pages; May 2007.

* cited by examiner

*Primary Examiner* — David Sample
*Assistant Examiner* — Nicholas W Jordan
(74) *Attorney, Agent, or Firm* — Fletcher Yoder, P.C.

(57) ABSTRACT

A cermet and method of forming the cermet, the cermet including a Sialon and an alloy comprising nickel aluminide and boron, wherein the Sialon includes silicon aluminum oxynitride, and wherein at least a portion of the Sialon is bonded with at least a portion of the alloy. In one example, the cermet is about 70 weight percent to about 90 weight percent of the Sialon, and about 10 weight percent to about 30 weight percent of the alloy.

36 Claims, 2 Drawing Sheets

EROSION RESISTANT MATERIAL

CROSS-REFERENCE TO RELATED APPLICATIONS

This application claims priority to and benefit of PCT Application No. PCT/US2008/075735, entitled "Erosion Resistant Material", filed on Sep. 9, 2008, which is herein incorporated by reference in its entirety, and which claims priority to and benefit of U.S. Provisional Patent Application No. 60/978,666, entitled "Erosion Resistant Material", filed on Oct. 9, 2007, which is herein incorporated by reference in its entirety.

FIELD OF THE INVENTION

The present invention relates generally to erosion resistant material. More particularly, the present invention relates to novel cermets and exemplary applications.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In the handling, processing, and transport of various substances (e.g., fluids, gases, vapors, liquids, solids, particulates, slurries, etc.), erosion of the associated equipment (e.g., pumps, fans, valves, piping, fittings, vessels, process equipment, machines, turbines, etc.) can occur. For example, equipment subjected to high velocity flow of a fluid may experience erosion, wear, abrasion, pitting, and the like. Such erosion can be greater or magnified where a flowing fluid contains solids or solid particles, for example. Moreover, such erosion can be greater at bends, turns, or other points or paths in a system where the equipment is subjected to centrifugal forces of a flowing fluid.

In general, erosion or pitting can cause premature failure of equipment, costly downtime of equipment and processes, undesirable releases of substances to the environment, and so on. In response, an approach in the art has been to fabricate or line components (which are subjected to erosive or abrasive flow) with hardened metals or with cermets, for example. However, such erosion-resistant materials can be relatively expensive. Further, such materials can have low ductility and be brittle, and therefore, prone to cracking or premature failure, difficult to fabricate (e.g., mold, machine, etc.), and so on.

SUMMARY

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below Aspects of the present invention include a cermet composition of (1) the ceramic Sialon or silicon aluminum oxynitride, and (2) an alloy metal comprising nickel aluminide and boron. In certain embodiments, the Sialon is about 70 weight percent to about 90 weight percent of the cermet, and the alloy metal is about 10 weight percent to about 30 weight percent of the cermet. The alloy metal may also include chromium, molybdenum, zirconium, and the like.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

Figure 1:
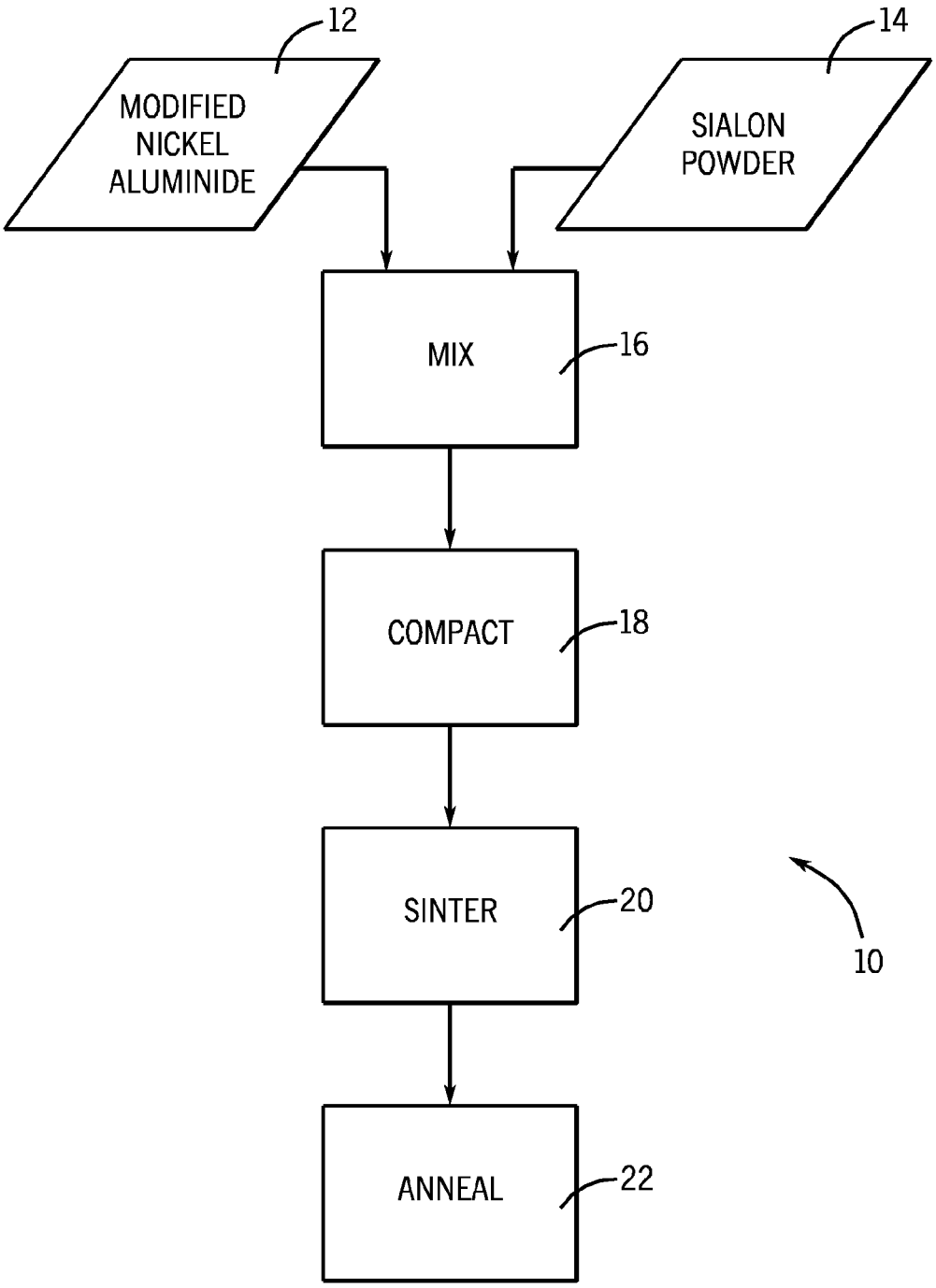
FIG. 1 is block flow diagram of an exemplary method for forming a novel cermet in accordance with one embodiment of the present invention.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

In certain embodiments, the present techniques provide for a cermet forged from two basic components: (1) the ceramic Sialon or silicon aluminum oxynitride, e.g., at about 85 weight % of the total cermet; and (2) the metal nickel aluminide (NiAl) alloyed with boron, e.g., at about 15 weight % of the cermet. The nickel aluminide may be obtained separately from the boron, and then alloyed with the boron. On the other hand, the nickel aluminide may be obtained as already modified (alloyed) with the boron. An exemplary metal nickel aluminide of the present techniques is a NiAl-boron alloy having about 200 ppm boron. Lastly, it should be noted that the silicon aluminum oxynitride and the nickel aluminide-boron alloy may incorporate other additives or elements (e.g., chromium, molybdenum, zirconium, etc.), typically in small or trace amounts.

In one embodiment, the two basic components, (1) ceramic Sialon and (2) metal nickel aluminide alloyed with boron, which are used to form the present cermets, may be obtained in powder form (or finely divided into powder form) and then mixed together (e.g., in a ball mill). The selected proportions of these two basic components may be a function of the cermet properties desired. The powder mixture of these two components may be processed by initially compacting the mixture (e.g., in closed dies) at high pressure (e.g., up to 50,000 psig and higher), followed by sintering at high temperature (e.g., up to 2300° F. and higher in an industrial oven). These sintered products may then be annealed. Further, for utility, these sintered products may be attached to other components by furnace brazing, incorporated in intermediate or final products (e.g., as a trim in a valve), and the like.

The surfaces of these new materials (cermets) generally have resistance to erosion and corrosion, and may be employed in chokes, valves, and other severe and/or high temperature service equipment. The properties of erosion resistance and corrosion resistance of these new cermets are due, at least in part, to the predicted hardness and energy absorbing properties of the new cermets. Indeed, these erosion and corrosion resistances may generally be obtained due to the predicted relatively high strength and modulus of resilience of the materials, as well as to the strength of the metallic bonding obtained from the aluminum atoms present in the component silicon aluminum oxynitride and in the component nickel aluminide-boron alloy.

Again, these cermets may be suitable for use as a trim material, for example, in chokes, valves, blades, and other service equipment, and so on. It is believed that these new cermets should generally exhibit up to about 50% (and more) longer life than other erosion resisting materials, such as tungsten carbide. Moreover, it is believed these cermets are generally less expensive and/or consequently more cost effective than other erosion resistant materials. These new materials will generally afford a more enduring material for erosion-resisting trims, seats, plugs, blades, and the like. The oil and gas industry, petroleum refineries, petrochemical operations, and other similar industries, for example, may incur increased life from process equipment that utilizes these new materials at points where wastage due to erosion/corrosion is a cause for failure.

Ceramic Component—Sialon

A ceramic component of the present cermets is Sialon, which is a silicon nitride ceramic with a small percentage of aluminum oxide. Sialon may be obtained as a fine grain nonporous material. Sialon is generally thermal shock resistant, strong, and is typically not wet or corroded by aluminum, brass, bronze, and other common industrial metals. The combination of silicon nitride and aluminum oxide produces a material (Sialon) typically with thermal shock resistance, wear resistance, fracture toughness, mechanical fatigue and creep resistance, oxidation resistance, strength, hardness, toughness, and so on. The low thermal expansion of silicon nitride is enhanced by corrosion resistance, high temperature strength, and oxidation resistance imparted by the aluminum oxide.

Sialon was generally developed as a more economic alternative to hot pressed silicon nitride. Sialons generally have a complex chemistry and are a family of alloys with a wide range of properties. They are formed when silicon nitride ($Si_3N_4$), aluminum oxide ($Al_2O_3$), and aluminum nitride (AlN) are reacted together. These components may combine over a wide compositional range. The Sialon family includes α-Sialon, β-Sialon, and other Sialons, and combinations thereof. Typical physical and mechanical properties of Sialon are tabulated in Table 1. Lastly, it should be noted that certain embodiments of the present techniques may accommodate the substitution of silicon nitride ($Si_3N_4$) in powder form as the ceramic component for the silicon aluminum oxynitride.

TABLE 1

Typical Physical and Mechanical Properties of Sialon

| Property | Value |
|---|---|
| Density (gram/cubic centimeter) | 3.2-3.3 |
| Porosity (%) | <1% |
| Flexural Strength (MegaPascal) | 760 |
| Elastic Modulus (GigaPascal) | 288 |
| Young's Modulus (GigaPascal) | 290 |
| Bend Strength (MegaPascal) | 800 |
| Hardness (GigaPascal) | 14-18 |
| Thermal Expansion Coefficient (×0.000001/° C.) | 3.0-3.3 |
| Maximum Operating Temperature (° C.) | 1000-1200 |

Metal Component—Nickel Aluminide (NiAl) Alloyed with Boron

Nickel aluminides are intermetallic materials that are useful, in part, due to their ordered crystal structure which makes them strong, hard, and generally melt at high temperatures. Unlike standard alloys, which typically have a disordered structure that becomes even more random and weaker at increasing temperatures, nickel aluminides with their ordered structure generally become stronger as their temperature rises (e.g., to about 800° C.).

However, nickel aluminides may be too brittle to be formed into many components for certain applications. Yet, nickel aluminides can be made more ductile with the addition of trace amounts of alloying elements (e.g., boron) in certain proportions. These modified nickel aluminides (i.e., nickel aluminide alloy compositions) may be attractive for industrial applications because they are commonly lighter (less dense) and about five times stronger than stainless steel, for example. They are generally affordable, i.e., they typically do not contain difficult-to-obtain materials of strategic value. On the other hand, such nickel aluminides may incorporate more expensive components, if desired.

A developer of modified nickel aluminides is Oak Ridge National Laboratory of Oak Ridge, Tenn. A nominal composition in weight percent of a modified nickel aluminide (Grade IC221M) manufactured by Alloy Engineering & Casting Company, which is licensed by Oak Ridge National Laboratory, is: nickel (balance); chromium (7.7); carbon (0.05 maximum); manganese (1.0 maximum); molybdenum (1.43); aluminum (8.0); zirconium (1.8); and boron (0.008). This exemplary modified nickel aluminide may be employed in the present techniques to form the embodiments of the present cermets.

Cermet—Exemplary Compositional Ranges

Exemplary compositional ranges of the new cermets are tabulated below.

TABLE 2

Exemplary Compositional Ranges of Cermet (in weight % of the cermet)

| Component | Range 1 | Range 2 | Range 3 |
|---|---|---|---|
| Ceramic: silicon aluminum oxynitride (Sialon)[1] | 60-95 | 70-90 | 80-90 |
| Metal: aluminum nitride-boron alloy[2] | 5-40 | 10-30 | 10-20 |

[1]The silicon aluminum oxynitride may incorporate additives.

[2]The nickel aluminide-boron alloy may incorporate additional materials.

Exemplary Manufacture and Applications

Turning now to the figures, FIG. 1 depicts an exemplary method 10 for forming novel cermets of the present techniques, the cermets having exemplary compositions discussed above. A modified nickel aluminum powder 12 and a Sialon powder 14 are provided. As discussed, the modified nickel aluminum powder 12 may be nickel aluminide having trace amounts of alloying elements (e.g., 200 ppm boron to improve ductility). The Sialon powder 14 may include a silicon nitride ceramic with a small percentage of aluminum oxide, and may include α-Sialon, β-Sialon, and other Sialons.

The modified nickel aluminum powder 12 and Sialon powder 14 are mixed (block 16). To facilitate mixing, the powders 12 and 14 may be mixed in a paraffin and solvent (such as hexane which dissolves the paraffin), for instance. Moreover, the powders 12 and 14 may be mixed in a ball mill or other mixing device, for example. Next, the powder mixture may then be compacted (e.g., subjected to pressures up to about 50,000 psig and greater) in molds or dies, for example, as indicated by reference numeral 18. It should be noted that the powder mixture may be compacted in a form (e.g., in the mold or die) of the desired part or product (e.g., a valve seat insert, valve plug, turbine blade, etc.).

As indicated by reference numeral 20, the compacted powder mixture may be heated and sintered (e.g., at about 2300° F. for 40 to 50 hours) to strengthen the powder mixture (increase bonding of the particles), to provide for densification of the powder mass, and to ultimately form a cermet, in this example. As indicated by reference numeral 20, the cermet (formed after the compacted powder is subjected to sintering in this example) may then be annealed at a suitable temperature followed by relatively slow cooling (quenching) to remove stresses, improve machinability, and so forth, to obtain a desired form or structure, and the like.

Figure 2:
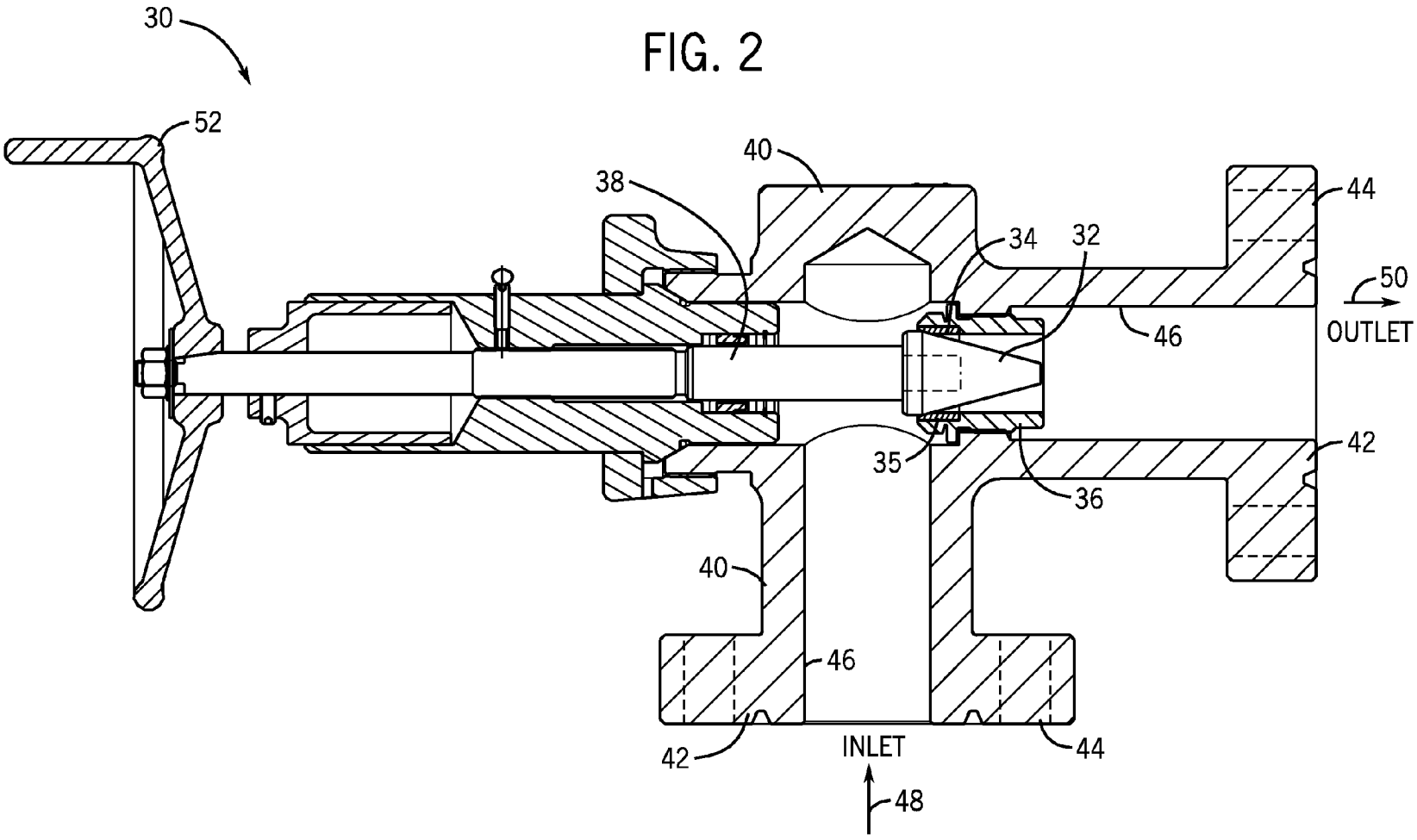
FIG. 2 is a perspective view of a choke valve incorporating a novel cermet in accordance with one embodiment of the present invention.

FIG. 2 depicts a choke valve 30 that may utilize the novel cermets 22. In this illustrative embodiment, the plug 32 and/or seat insert 34 may be lined or constructed from the cermet 22. The cermet 22 may provide for decreased erosion at the interface 35 of the plug 32 and seat insert 34. The seat insert 34 is a cylinder resting inside the seat 36 (e.g., stainless steel). The plug 34 may be coupled to a stem 38 (e.g., stainless steel). The plug 32, seat insert 34, and seat 36 may be disposed inside the valve body 40 (e.g., forged alloy steel). The valve body 40 may have flanges 42 (with bolt holes 44) and an inner surface 46. On the other hand, the valve 30 may be screwed, for example, and not flanged.

In operation, a fluid (with any solids or particulates) enters the inlet 48 of the valve 30, flows through an opening between the plug 32 and seat insert 34 (and seat 36), and discharges through the outlet 50. The valve 30 may be opened (i.e., forming an opening between the plug 32 and seat 36) by turning a valve handle 52, for example, which retracts the stem 38 and plug 32 away from the seat 36. Of course, the valve 30 may be configured to open via means other than a handle 52. The cermet 22 may extend the life of the valve 30 due to increased erosion resistance of the plug 32 and/or seat insert 34.

Lastly, it should be noted that various testing techniques and standards may be employed to test the erosion rate of the cermet 22. The cermet 22 may be formed in to biscuits or coupons, for example, and subjected to erosion test (e.g., ASTM G76). The cermet 22 may be also tested for abrasion resistance (e.g., ASTM G65), as well as corrosion resistance to various chemicals.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A valve, comprising:

a valve body have a passage extending between an inlet and an outlet; and a valve member disposed along the valve passage, wherein the valve member is configured to move between an open position and a closed position relative to a valve seat along the valve passage, wherein the valve member or the valve seat comprises an erosion resistant cermet material composition having 80-90 percent by weight of a silicon aluminum oxynitride (Sialon) and 10-20 percent by weight of a nickel aluminide-boron alloy.

2. The valve of claim 1, comprising an erosive fluid source component coupled to the valve, wherein the erosive fluid source component is configured to flow an erosive fluid through the valve.

3. The valve of claim 2, wherein the erosive fluid comprises solids or particulates in a fluid.

4. The valve of claim 1, wherein the erosion resistant cermet material composition has approximately 85 percent by weight of the Sialon and approximately 15 percent by weight of the nickel aluminide-boron alloy.

5. The valve of claim 4, wherein the nickel aluminide-boron alloy has less than 200 ppm boron.

6. The valve of claim 1, wherein the erosion resistant cermet material composition has aluminum in the Sialon and aluminum in the nickel aluminide-boron alloy metallically bonded together.

7. The valve of claim 1, wherein the Sialon comprises α-Sialon.

8. The valve of claim 1, wherein the Sialon comprises β-Sialon.

9. The valve of claim 1, wherein the valve seat comprises the erosion resistant cermet material composition.

10. The valve of claim 9, wherein the valve seat comprises a seat insert.

11. The valve of claim 9, wherein the valve seat is lined with the erosion resistant cermet material composition.

12. The valve of claim 9, wherein the valve seat is constructed entirely with the erosion resistant cermet material composition.

13. The valve of claim 1, wherein the valve member comprises the erosion resistant cermet material composition.

14. The valve of claim 13, wherein the valve member comprises a plug.

15. The valve of claim 13, wherein the valve member is lined with the erosion resistant cermet material composition.

16. The valve of claim 13, wherein the valve member is constructed entirely with the erosion resistant cermet material composition.

17. The valve of claim 1, wherein the valve is a choke valve configured to hold the valve member in a position between the open position and the closed position to choke a flow through the choke valve.

18. The valve of claim 1, wherein the erosion resistant cermet material composition consists essentially of the Sialon and the nickel aluminide-boron alloy.

19. The valve of claim 1, wherein the erosion resistant cermet material composition consists of the Sialon and the nickel aluminide-boron alloy.

20. A valve, comprising:

a valve body have a passage extending between an inlet and an outlet; and a valve member disposed along the valve passage, wherein the valve member is configured to move between an open position and a closed position relative to a valve seat along the valve passage, wherein at least part of the valve is made of an erosion resistant cermet material composition consisting essentially of a silicon aluminum oxynitride (Sialon) and a nickel aluminide-boron alloy in sufficient amounts to provide erosion resistance against an erosive fluid.

21. The valve of claim 20, wherein the erosion resistant cermet material composition consists of the Sialon and the nickel aluminide-boron alloy.

22. The valve of claim 20, wherein aluminum in the Sialon and aluminum in the nickel aluminide-boron alloy are metallically bonded together, wherein the erosion resistant cermet material composition has 80-90 percent by weight of the Sialon and 10-20 percent by weight of the nickel aluminide-boron alloy.

23. The valve of claim 20, comprising an erosive fluid source component coupled to the valve, wherein the erosive fluid source component is configured to flow the erosive fluid through the valve.

24. The valve of claim 20, wherein the erosive fluid comprises solids or particulates in a fluid.

25. The valve of claim 20, wherein the erosive fluid comprises an erosive liquid.

26. The valve of claim 20, wherein the valve is configured to hold the valve member in a position between the open position and the closed position to choke a flow of the erosive fluid.

27. An erosion resistant cermet material composition, consisting essentially of a silicon aluminum oxynitride (Sialon) and a nickel aluminide-boron alloy, wherein aluminum in the Sialon and aluminum in the nickel aluminide-boron alloy are metallically bonded together, wherein the erosion resistant cermet material composition has 80-90 percent by weight of the Sialon and 10-20 percent by weight of the nickel aluminide-boron alloy.

28. The erosion resistant cermet material composition of claim 27, wherein the erosion resistant cermet material composition consists of the Sialon and the nickel aluminide-boron alloy.

29. The erosion resistant cermet material composition of claim 27, wherein the erosion resistant cermet material composition has approximately 85 percent by weight of the Sialon and approximately 15 percent by weight of the nickel aluminide-boron alloy.

30. A method, comprising:

flowing an erosive fluid through a passage extending between an inlet and an outlet of a valve body of a valve, wherein a valve member is disposed along the valve passage, and the valve member is configured to move between an open position and a closed position relative to a valve seat along the valve passage; and resisting erosion along the valve passage with an erosion resistant cermet material composition having 80-90 percent by weight of a silicon aluminum oxynitride (Sialon) and 10-20 percent by weight of a nickel aluminide-boron alloy.

31. The method of claim 30, wherein flowing the erosive fluid comprises flowing the erosive fluid having solids or particulates in a fluid.

32. The method of claim 30, comprising holding the valve member in a position between the open position and the closed position to choke the flow of the erosive fluid.

33. The method of claim 30, wherein resisting erosion comprises resisting erosion of the valve member with the erosion resistant cermet material composition.

34. The method of claim 30, wherein resisting erosion comprises resisting erosion of the valve seat with the erosion resistant cermet material composition.

35. The method of claim 30, wherein the erosion resistant cermet material composition has approximately 85 percent by weight of the Sialon and approximately 15 percent by weight of the nickel aluminide-boron alloy.

36. The method of claim 30, wherein the nickel aluminide-boron alloy comprises a grade IC221M having nickel (balance); chromium (7.7); carbon (0.05 maximum); manganese (1.0 maximum); molybdenum (1.43); aluminum (8.0); zirconium (1.8); and boron (0.008).

* * * * *